United States Patent [19]

Parrish

[11] 3,957,327

[45] May 18, 1976

[54] PROTECTIVE COVER FOR WEDDING CAKES, OR OTHER DISPLAY ITEMS

[75] Inventor: Richard A. Parrish, Costa Mesa, Calif.

[73] Assignee: Parrish's Cake Decorating Supplies, Inc., Los Angeles, Calif.

[22] Filed: Nov. 4, 1974

[21] Appl. No.: 520,267

[52] U.S. Cl. ..... 312/284; 220/4 R; 312/108

[51] Int. Cl.² ..... A47B 47/00

[58] Field of Search ..... 312/108, 111, 114, 284; 220/4 R, 4 B, 4 E; 206/45.32

[56] References Cited

UNITED STATES PATENTS

| | | | |
|---|---|---|---|
| 423,543 | 3/1890 | Tommins | 312/284 |
| 3,092,277 | 6/1963 | Brim | 220/4 E |
| 3,493,142 | 2/1970 | Assmann | 220/4E |
| 3,722,704 | 3/1973 | Piatetti | 312/108 |
| 3,847,458 | 11/1974 | Nowak | 312/108 |

FOREIGN PATENTS OR APPLICATIONS

| | | | |
|---|---|---|---|
| 476,613 | 9/1969 | Switzerland | 312/284 |

*Primary Examiner*—Casmir A. Nunberg
*Attorney, Agent, or Firm*—Romney Schaap Golant Scillieri & Ashen

[57] ABSTRACT

A frusto-conical protective cover for a wedding cake or other articles. The cover is divided into at least two identical, upwardly convergent sections in the vertical direction, the cover sections being positionable in face-to-face relation to form the cover, and being positionable in nested relation when the cover is not in use. The cover includes integral interlocking means on the cover sections for interlocking same with the cover sections in either their face-to-face relation, or their nested relation. The interlocking means comprises channels interlockable with snap fits and formed in outwardly extending, upwardly convergent flanges extending outwardly from the upwardly convergent edges of the cover sections. The cover sections are provided at their lower ends with outwardly extending base flanges which form an annular flange to stabilize the cover when the cover sections are in their face-to-face relation. The cover sections are provided at their upper ends with top walls having abuttable, radial stiffening ribs.

6 Claims, 6 Drawing Figures

PROTECTIVE COVER FOR WEDDING CAKES, OR OTHER DISPLAY ITEMS

BACKGROUND OF INVENTION

The present invention relates in general to a protective cover for wedding cakes, or other display items.

As is well known, wedding cakes are frequently very elaborate structures which may attain substantial heights. Desirably, wedding cakes should be protected against contamination between the time they are completed and the time they are cut during the receptions which customarily follow weddings. In the past, all kinds of makeshift covers have been used for protective purposes, but, to my knowledge, none of these have been completely satisfactory.

OBJECTS AND SUMMARY OF INVENTION

In view of the foregoing, the primary object of the invention is to provide a very simple and effective protective cover for wedding cakes, or other articles, and one which takes up a minimum of space when not in use.

More particularly, an important object of the invention is to provide a self-sustaining protective cover, and one which is preferably transparent so that the wedding cake, or other articles, may be viewed therethrough readily.

The invention may be summarized as comprising, and an important object of the invention is to provide a cover which comprises, a housing, preferably upwardly convergent, divided into at least two identical sections in the vertical direction, the cover sections being positionable in face-to-face relation to form the cover and being positionable in nested relation when the cover is not in use, as when it is being returned to the bakery, for example, or being stored. Still another important object is to provide interlocking means integral with the cover sections for interlocking same with the cover sections in their face-to-face relation, and also in their nested relation.

Still another object of the invention is to provide a frusto-conical protective cover wherein the cover sections are provided with upwardly convergent edges having outwardly extending, upwardly convergent flanges in which the interlocking means mentioned are formed.

Yet another object is to provide a protective cover wherein the interlocking means comprise interlockable channels in the upwardly convergent flanges mentioned, each channel on each of the cover sections being interlockable with one of the channels on another of the cover sections when the cover sections are in their face-to-face relation, and being interlockable with one of the channels on another cover section when the cover sections are in their nested relation.

An additional object is to provide a construction wherein the cover sections are formed of a transparent flexible material, such as a suitable plastic, and wherein the interlocking channels are interlockable with snap fits, a related object being to provide the channels with dovetail cross sections.

A further object is to provide the cover sections at their lower ends with outwardly extending base flanges which cooperate to provide a continuous, annular base flange to stabilize the frusto-conical cover when the cover sections are in their face-to-face relation.

Still another object is to provide a construction wherein the cover sections are provided at their upper ends with top walls having abuttable, radial stiffening ribs.

With the foregoing construction, the cover sections are readily interlocked in both their face-to-face relation and their nested relation, without any necessity for any auxiliary interlocking means. Thus, the invention provides a protective cover which performs its intended function very effectively, but which occupies a minimum of space during transport and storage, which are important features.

The foregoing objects, advantages, features and results of the present invention, together with various other objects, advantages, features and results which will be evident to those skilled in the protective cover art in the light of this disclosure, may be achieved with the exemplary embodiment of the invention illustrated in the accompanying drawing, and described in detail hereinafter.

DESCRIPTION OF EXEMPLARY EMBODIMENT OF INVENTION

Figure 1:
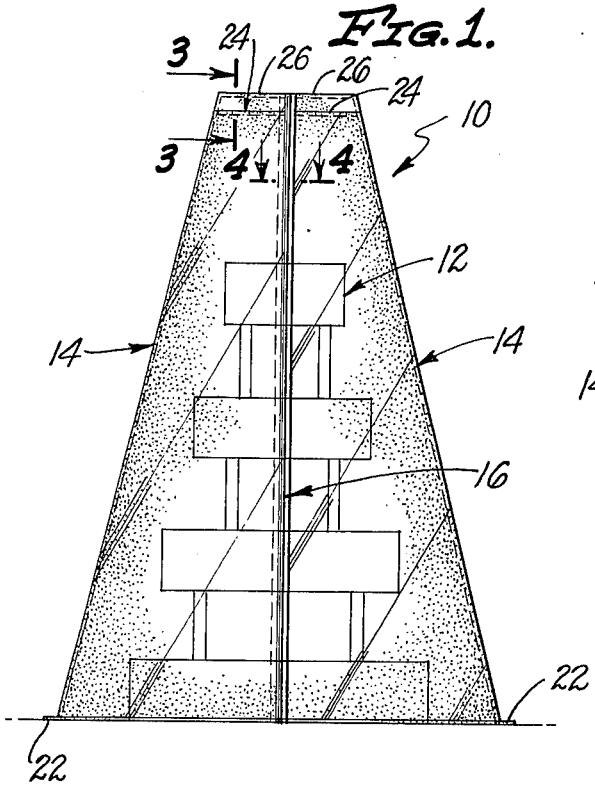
FIG. 1 is a side elevation of a protective cover of the invention, FIG. 1 further showing that the protective cover has a frusto-conical configuration and is divided into two halves in a substantially vertical plane containing the axis of the cover, the two halves being disposed in face-to-face relation when the cover is in its operative condition.

Referring to the drawing, designated generally therein by the numeral 10 is a frusto-conical protective cover for a wedding cake 12. The specific cover 10 shown is divided into two identical sections or halves 14 in a substantially vertical plane containing the axis of the cover. However, the cover 10 may be divided vertically into more than two identical sections, e.g., three or four. For convenience, this portion of the present specification will be restricted to a disclosure of the two cover halves 14 specifically shown.

Figure 2:
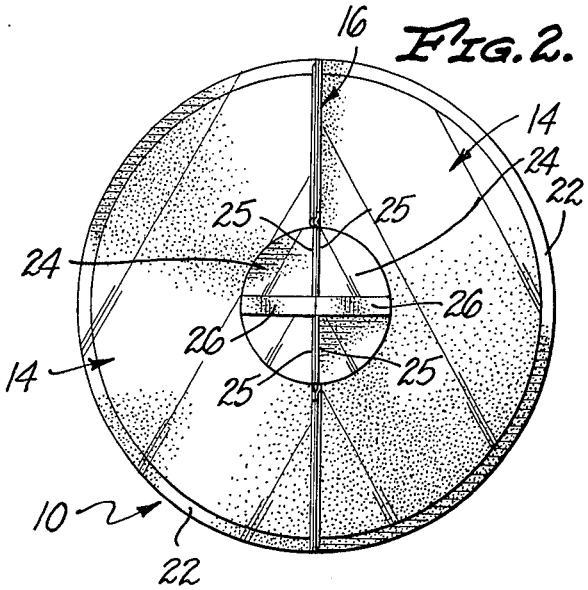
FIG. 2 is a top plan view of the protective cover in the condition in which it is shown in FIG. 1 of the drawing.
Figure 4:
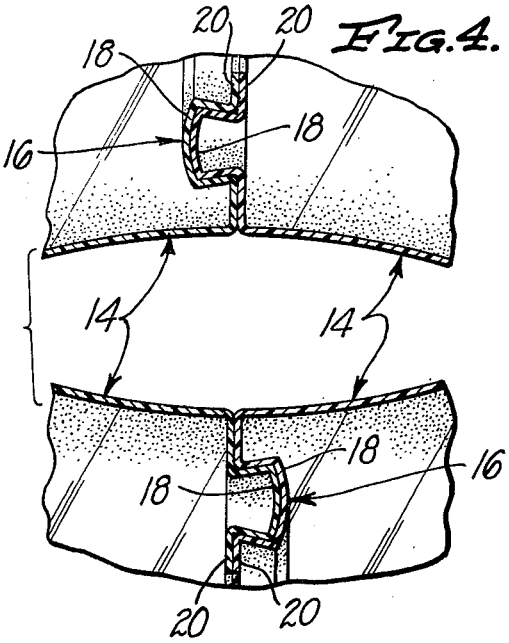
Figure 5:
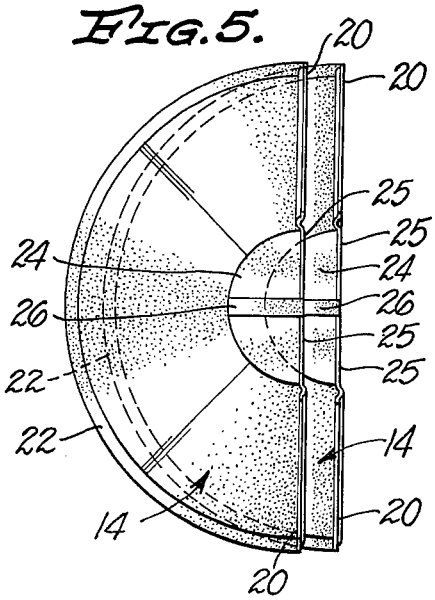
FIG. 5 is a top plan view showing the two cover halves in a partially nested condition or relation.

The cover halves 14 are positionable in face-to-face relation, as shown in FIGS. 1, 2 and 4, to form the cover 10. When the cover 10 is not in use, as during storage or shipment, the two cover halves 14 are positionable in nested relation, the two halves being shown partially nested in FIG. 5, and being shown fragmentarily in a completely nested condition in FIG. 6.

The protective cover 10 is preferably formed of a transparent plastic material so that the wedding cake 12 can be viewed therethrough readily. The transparent plastic material forming the protective cover is sufficiently thick that the cover is self supporting. However, the plastic material is thin enough to render the cover halves 14 flexible for a purpose to be described.

Figure 6:
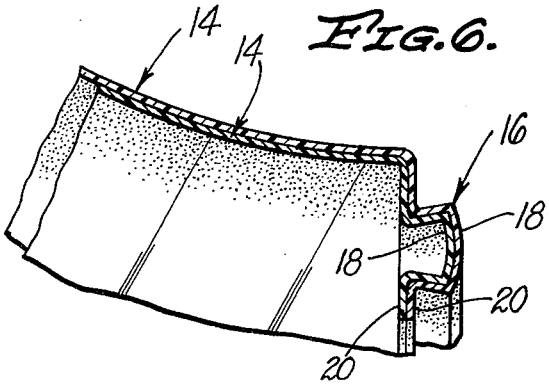
FIG. 6 is an enlarged, fragmentary sectional view showing the manner in which the two cover halves are interlocked in their fully nested condition or relation.

The protective cover 10 includes integral interlocking means 16 on the cover halves 14 for interlocking same with the cover halves in either their face-to-face relation, as shown in FIGS. 1, 2 and 4, or in their nested relation, as shown in FIG. 6. More particularly, the interlocking means 16 comprises dovetail channels 18 interlockable with snap fits and formed in outwardly extending, upwardly convergent flanges 20 extending outwardly from the respective upwardly convergent edges of the cover halves 14.

More particularly, there are two of the upwardly convergent, outwardly extending flanges 20 on each cover half 14, and each such flange has one of the dovetail channels 18 formed therein. As will be apparent from FIG. 4, the channels 18 in each cover half 14 face in opposite directions when viewed from above. Considered from an alternative standpoint, the channels 18 in each cover half face clockwise when viewed from above.

The channels 18 are interengageable with snap fits, the plastic material of the cover halves 14 being sufficiently flexible to achieve such fits. Thus, when the cover halves 14 are in their face-to-face relation, as shown in FIGS. 1, 2 and 4, to form the protective cover 10, the four channels 18 are interlocked with snap fits, as best shown in FIG. 4. When the cover halves are in their nested relation, the channels 18 are interlocked, as will be clear from the two channels shown in FIG. 6.

Thus, the interlocking means 16 integral with the cover halves 14 operates in substantially the same way in both the face-to-face relation of the cover halves 14 and the nested relation thereof. More particularly, each channel 18 on one of the cover halves 14 is interlockable with one of the channels 18 on the other of the cover halves 14 when the cover halves are in their face-to-face relation, and is interlockable with the other of the channels 18 on such other cover half 14 when the cover halves are in their nested relation.

For stability in the operating condition of the protective cover 10 (and in the nested condition thereof), the cover halves 14 are provided at their lower, larger ends with outwardly extending, semiannular base flanges 22. When the cover halves 14 are in their face-to-face relation, the two semiannular base flanges 22 cooperate to provide an annular base flange for the over-all protective cover 10.

Figure 3:
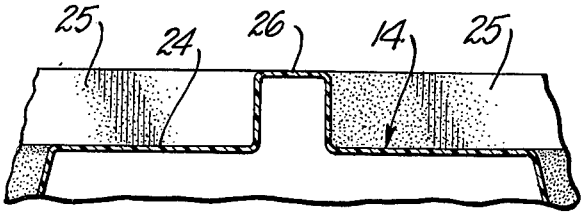
FIGS. 3 and 4 are enlarged, fragmentary sectional views respectively taken as indicated by the arrowed lines 3—3 and 4—4 of FIG. 1.

The cover halves 14 are provided at their upper ends with semicircular top walls 24 the diametral edges of which have flanges 25 abutting when the cover halves are in their face-to-face relation. The top walls 24 also have abuttable, radial stiffening ribs 26, best shown in FIGS. 2 and 3 of the drawing.

Although an examplary embodiment of the invention has been disclosed for illustrative purposes, it will be understood that various minor changes, modifications and substitutions may be incorporated in such embodiment without departing from the invention as defined by the claims hereinafter appearing.

I claim as my invention:

1. A protective cover for decorative cakes and the like which rest on an underlying support surface, comprising a body portion formed of flexible transparent material with upstanding upwardly convergent walls and including overlapping edges removably connected together by seam means for enclosing the cake in a conical chamber formed between said body portion and the support surface, said body portion further including bottom edge means engaging the support surface at a location displaced from the outer edge of the cake for supporting said body portion over the cake without contacting the cake.

2. The device of claim 1 wherein said body portion includes a cap member attached to an integral with the top of said upstanding walls to form a frusto-conical chamber for the cake.

3. The device of claim 1 wherein said seam means comprises said overlapping edges formed into channels which interlock with each other.

4. The device of claim 1 wherein said overlapping edges extend along opposite sides of said body portion to divide said body portion into two sections.

5. The device of claim 1 wherein said body portion includes two identical sections positionable in face-to-face relation to form said cover and positionable in nested relation when said cover is not in use.

6. The device of claim 5 wherein said seam means includes interlocking means on said body portion for interlocking adjacent edges of said sections in either face-to-face or nested relation.

* * * * *